US007997353B2

(12) United States Patent
Ochoa

(10) Patent No.: US 7,997,353 B2
(45) Date of Patent: Aug. 16, 2011

(54) THROUGH TUBING PERFORATING GUN

(75) Inventor: Luis Ochoa, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 12/175,935

(22) Filed: Jul. 18, 2008

(65) Prior Publication Data

US 2010/0012312 A1 Jan. 21, 2010

(51) Int. Cl.
*E21B 43/117* (2006.01)
*E21B 43/11* (2006.01)

(52) U.S. Cl. ..... 175/4.53; 175/4.6; 166/297

(58) Field of Classification Search ..... 175/4.53, 175/4.6; 166/297
See application file for complete search history.

(56) References Cited

U.S. PATENT DOCUMENTS 2,690,123 A * 9/1954 Kanady ..... 175/4.52
2,883,932 A * 4/1959 Caldwell ..... 175/4.53
2,947,253 A * 8/1960 Cirilo ..... 175/4.53
5,095,801 A * 3/1992 Lopez de Cardenas ..... 89/1.15
5,816,343 A 10/1998 Markel et al.
6,591,911 B1 7/2003 Markel et al.
2004/0206503 A1 10/2004 Bell et al.

OTHER PUBLICATIONS

Ott, R.E., et al., Simple Method Predicts Downhole Shaped-Charge Gun Performance, SPE Production & Facilities, Aug. 1994, Society of Petroleum Engineers, pp. 171-178, pp. 292-295, SPE 27424 (includes Discussion and Author's Reply).

* cited by examiner

*Primary Examiner* — Giovanna C Wright
(74) *Attorney, Agent, or Firm* — Kevin B. McGoff; Rodney V. Warfford

(57) ABSTRACT

An apparatus for perforating wells has perforating charges and a means for retaining the perforating charges in a first array The first array has a first maximum cross sectional area; and means for expanding the perforating charges into a second three dimensional array The second array has a second maximum cross sectional area larger than the first maximum cross sectional area. Also an apparatus for perforating wells has a plurality of perforating charges and a means for retaining the perforating charges in a first array The first array has a primary axis and a first maximum cross sectional area and the perforating charges having firing directions oriented approximately perpendicular to the primary axis; and means for expanding the perforating charges into a second array, the second array has a second maximum cross sectional area larger than the first.

10 Claims, 6 Drawing Sheets

THE USE OF FLANGES ON A MOVING PLUG TO INCREASE CROSS SECTIONAL AREA

EXAMPLE EFFECT OF GUN-TO-CASING CLEARANCE

THE USE OF FLANGES ON A MOVING PLUG
TO INCREASE CROSS SECTIONAL AREA

THE USE OF ROTATING MOTION TO INCREASE THE CROSS SECTIONAL AREA OF THE PERFORATING GUN

THE USE OF A "WEDGE" TO INCREASE THE CROSS SECTIONAL AREA OF THE GUN

THE USE OF A PUMP TO INFLATE THE CHARGES CARRIER TO INCREASE CROSS SECTIONAL AREA

THE USE OF A PUMP TO INFLATE AN INTERNAL "BLADDER" TO INCREASE THE CROSS SECTIONAL AREA OF THE PERFORATING GUN

THE USE OF INTERNAL PRESSURE TO EXTEND THE CHARGES CLOSER TO THE CASING

A "SPRING" LIKE FLANGE UNDER TENSION THAT INCREASES THE CROSS SECTIONAL AREA OF THE PERFORATING GUN WHEN THE TENSION IS RELEASED

USING TWO FLANGES TO POSITION CHARGES IN THE OPPOSITE SIDES OF THE CASING

THREE FLANGE EXAMPLE WITH ALTERNATING SHAPE CHARGES AND USING A THREE PART STRUCTURAL SUPPORT

THROUGH TUBING PERFORATING GUN

FIELD OF DISCLOSURE

The present application is generally related to the perforating of hydrocarbon wells, and more particularly to methods and apparatus associated with the perforating of hydrocarbon wells that have reduced internal diameter wellbores that restrict the size of perforating guns that may be used. The use of a multitude of ways to increase the outer size of the perforating gun once the restriction has been cleared, and thereby reducing the distance between the shaped charge and the wellbore wall, will be discussed in the present disclosure by ways of several examples that are meant to illustrate the underlying inventive concepts and not to restrict in any way the disclosure.

BACKGROUND OF DISCLOSURE

Hydrocarbon wells are often completed with a production tubing prior to perforating the wellbore for multiple reasons; including, but not limited to, the high pressure seen in the wellbore after the casing has been perforated. It's this high pressure that does not allow the subsequence safe lowering of a production string into a "live" well. Because of this, in a large percentage of hydrocarbon wells the production tubing string is put in place prior to perforating the well. To counteract this high pressure, the well can be controlled or killed with heavy fluids before the tubing is run (or before the perforating gun is run) but this fluid may damage the formation. It is well documented and known in the art that these control or heavy fluids can drastically reduce a well's productivity. Other reasons for perforating after production tubing has been placed in the well may include the cost of a drilling rig. The operator may choose to run production tubing with a drilling rig and replace it with a less costly work over rig for operations like perforating, well clean up, well testing, well hook up, etc. and the work over rig may not have the capacity to safely and efficiently run production tubing into the well so it must be done by the drilling rig.

The service industry has devised ways to perforate a well with a production tubing in place but not without compromising the time and cost needed to perforate the well or the performance of the perforating guns themselves. One can divide the methods currently used to perforate a well with the production tubing in place into two main categories: perforating casing guns that are run before or attached to the production tubing and through tubing perforating guns.

Perforating casing guns can be run and hung in place by a plug like device to be activated at a later time after the production tubing is run. The activation means are varied, it could be pressure activated, time activated, a combination of time and pressure or by lowering a firing head via wireline. Casing guns can also be deployed with the production tubing string by hanging it onto the bottom of the tubing string. In both cases, after the perforating gun is activated the remaining hardware of the casing gun is dropped down to the sump of the well. These two techniques using casing guns allow the operators to use the biggest possible guns, bigger guns usually result in deeper penetration and better flow of hydrocarbons. It will also allow them to leave the proper clean and light fluid in place in the wellbore at the time of perforating to avoid damage to the formation. However some complications and additional work is needed for this type of operation, the well needs to be drilled and cased deeper to account for a sump large enough to house the casing guns that will be dropped after firing. There is also the chance that a casing gun dropping mechanism will not work as intended or that the dropped gun does not drop all the way down to the bottom of the sump and could obstruct the producing interval.

The second alternative is to use through tubing guns. These guns are typically of a smaller diameter than the casing guns as it needs to be able to go through the production tubing string and all of its restrictions of internal diameter. Most of the through tubing guns are of the exposed gun type. Exposed guns were designed without the hollow carrier that typically characterizes casing guns in an effort to use the largest possible shaped charge that will fit a certain restriction of internal diameter. As is widely documented and a person of ordinary skill in the art will know, through tubing guns are optimized to carry the largest possible shape charges as the challenge to create a deep enough perforating tunnel with a small perforating gun are several. As an example, a 5 inch casing will typically be perforated with a 3⅜ inch casing gun but if the production tubing is run before the well is perforated, the through tubing gun normally used will be 2½ inch (for a 5 inch casing size the production tubing string will typically be 3½ inch).

As is widely documented, the "water clearance" or distance from a shaped charge to the inside face of a casing will impact the total penetration of a shaped charge negatively as the water clearance increases. This is one of the reasons, among others, that the use of a smaller perforating gun will typically reduce the depth of penetration of shaped charges facing towards the largest water clearance. To counter this effect, some guns are designed to what is called zero phase, this is all the shaped charges are looking in the same direction, and are oriented with devices like magnets or bowsprings so the shaped charges are facing the casing, thereby minimizing the water clearance. A downside of using zero phased guns, among others, is that the drainage of the reservoir is not as efficient as if a helicoidally or spiral designed gun is used.

Helicoidally or spiral designed guns will transport more charges downhole on a gun of the same length as a zero phased gun and therefore have more area open to flow fluids from the reservoir. As mentioned above, the shaped charges with the largest separation from the casing wall will see its depth of penetration reduced. In an example of a 5 inch casing, with internal diameters typically ranging between 4.560 inches and 4.006 inches, a through tubing perforating gun that typically might be used is a 2½ inch external diameter perforating gun and it is to be assumed that the perforating gun will always be in contact with one side of the casing leaving a large clearance for the shaped charges facing opposite to the casing/perforating gun contact. One type of through tubing gun is described in U.S. Pat. No. 5,816,343 entitled "Phased perforating guns" issued Oct. 6, 1998 to Schlumberger Technology Corporation. Another type of through tubing perforating gun is disclosed in U.S. Pat. No. 6,591,911 entitled "Multi-directional gun carrier method and apparatus" issued Jul. 15, 2003 to Schlumberger Technology Corporation. Another design of through tubing guns aimed to both reduce the water clearance and to lower the biggest possible charge through the restrictions of a production tubing is commonly known in the industry as the "Pivot Gun" and is described in U.S. Pat. No. 5,095,801 entitled "Pivot gun having charges which slidingly engage a stationary detonating cord and apparatus for deploying the charges" by Jorge E. Lopez de Cardenas issued Mar. 17, 1992 and assigned to Schlumberger Technology Corporation.

References to the decrease in depth of penetration a shaped charge can suffer from increased water clearance can be found, among multiple other publications in the public domain and in the knowledge of those skilled in the art, in SPE (Society of Petroleum Engineers) Article No. 27424 entitled "Simple Method Predicts Downhole Shaped Charge Gun Performance" published in August 1994 by R. E. Ott et al.

In an effort to counteract the effects of having to use a small gun in a well with a production tubing in place some operators have come up with innovative ideas, some involve running the perforating gun on the outside of the casing. This method is described in Published U.S. Patent Application 20040206503 entitled "Casing conveyed well perforating apparatus and method" filed May 6, 2004 and assigned to Shell Oil Co.

SUMMARY OF THE DISCLOSURE

The following embodiments provide examples and do not restrict the breath of the disclosure and will describe ways to get shaped charges of a through tubing perforating gun of a certain size, designed to go through restrictions of internal diameters, closer to the casing wall prior to firing in order to minimize the water clearance. By minimizing the water clearance, a through tubing gun can achieve deeper penetration of the majority of the charges lowered into the well, therefore increasing the chances of better productivity of the well.

An apparatus for perforating wells having a plurality of perforating charges; means for retaining the perforating charges in a first array, the first array having a first maximum cross sectional area; and means for expanding the perforating charges into a second three dimensional array, the second array having a second maximum cross sectional area larger than the first maximum cross sectional area.

Also an apparatus for perforating wells having a plurality of perforating charges; means for retaining the perforating charges in a first array, the first array having a primary axis and a first maximum cross sectional area and the perforating charges having firing directions oriented approximately perpendicular to the primary axis; and means for expanding the perforating charges into a second array, the second array having a second maximum cross sectional area larger than the first maximum cross sectional area.

Further features and advantages of the invention will become more readily apparent from the following detailed description when taken in conjunction with the accompanying drawings.

BRIEF DESCRIPTION OF THE DRAWINGS

An example of the effect of water clearance on penetration depth of a shaped charge is depicted in FIG. 1.

An example embodiment of the present disclosure is depicted in FIG. 2, wherein three flanges are compressed in order to increase the external diameter of the perforating gun.

Figure 3:
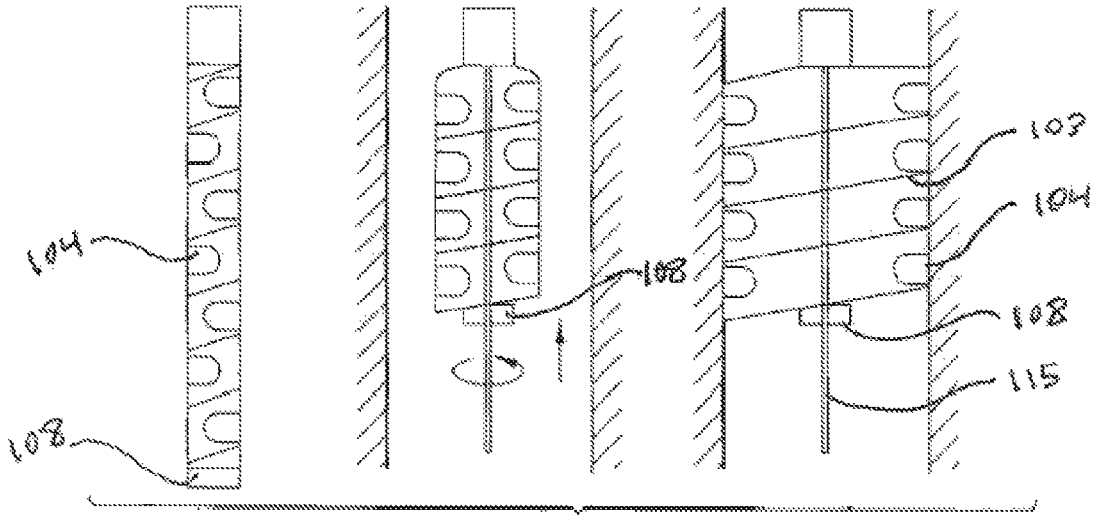

Another example embodiment of the present disclosure is depicted in FIG. 3, wherein a spiral flange loaded with charges is turned in order to increase the external diameter of the perforating gun.

Figure 4:
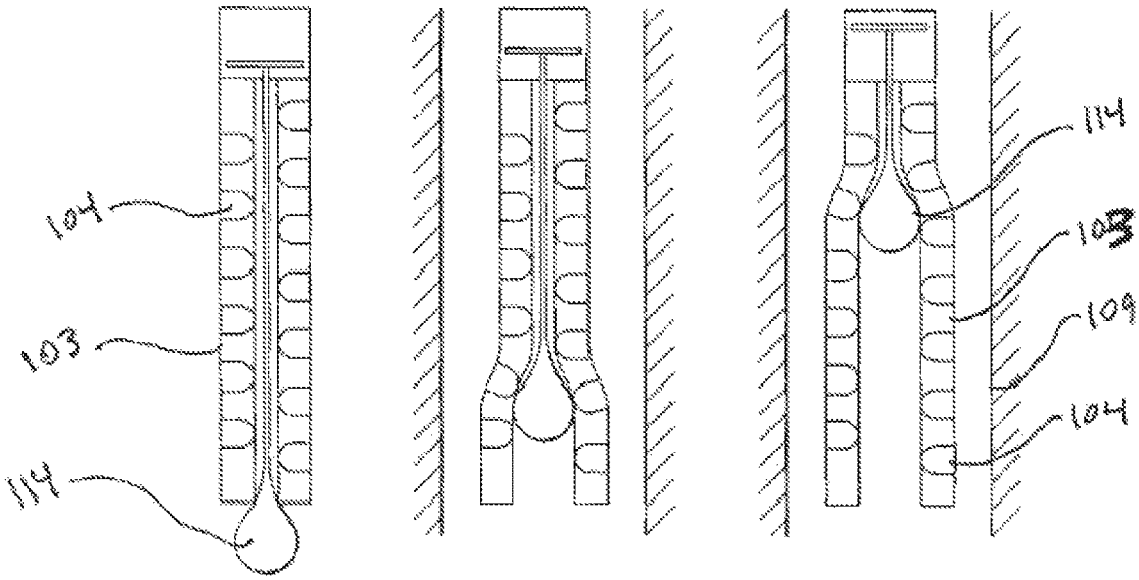

A further example embodiment of the present disclosure is depicted in FIG. 4, wherein a wedge is forced along the length of the perforating gun in order to increase the external diameter of the perforating gun.

Figure 5:
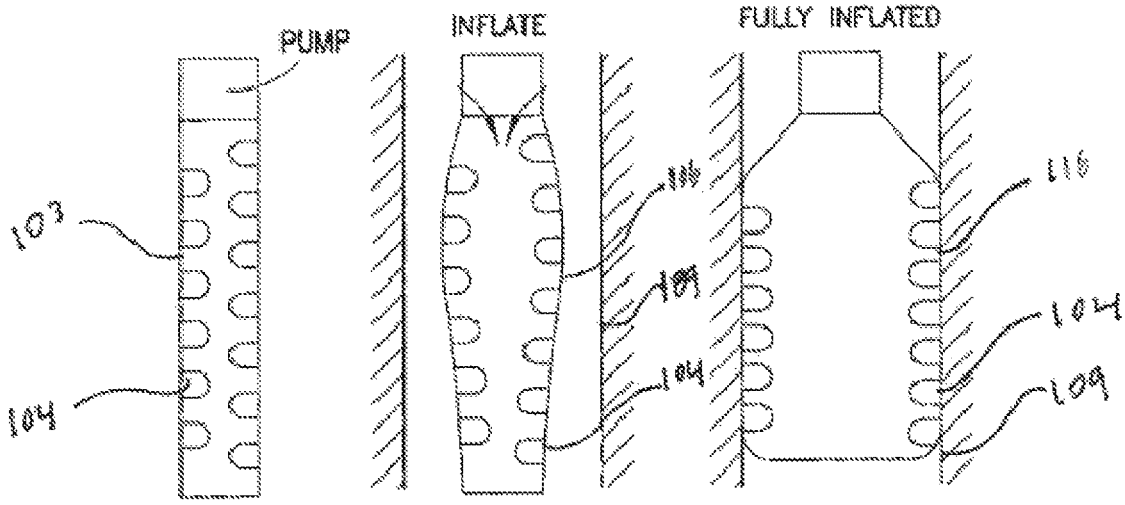

An additional example embodiment of the present disclosure is depicted in FIG. 5, wherein the shaped charges are placed in an inflatable media that increases the external diameter of the perforating gun by pumping fluid into the inflatable media.

Figure 6:
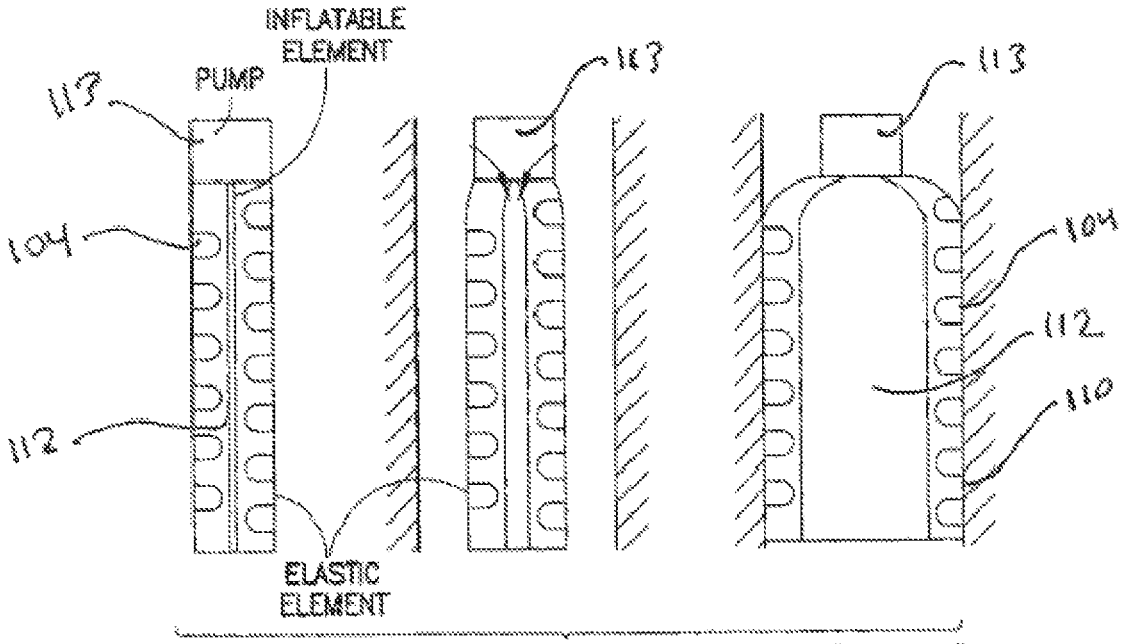

A further example embodiment of the present disclosure is depicted in FIG. 6, wherein shaped charges are placed in an expandable media which will increase the diameter of the gun by inflating a bladder type inflatable media located in the core of the gun.

Figure 7:
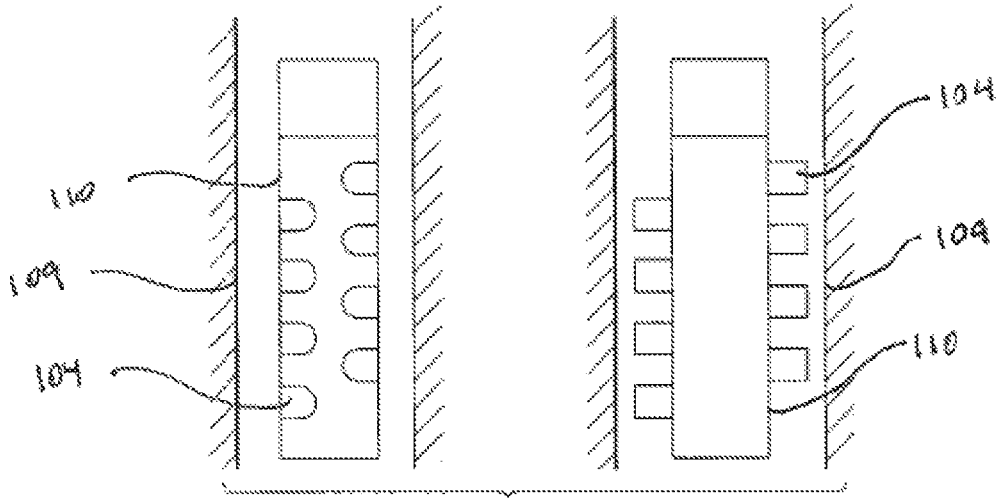

Another example embodiment of the present disclosure is depicted in FIG. 7, wherein the charges are hosted in chambers which will protrude from the gun by applying pressure inside the gun or by mechanical means.

Figure 8:
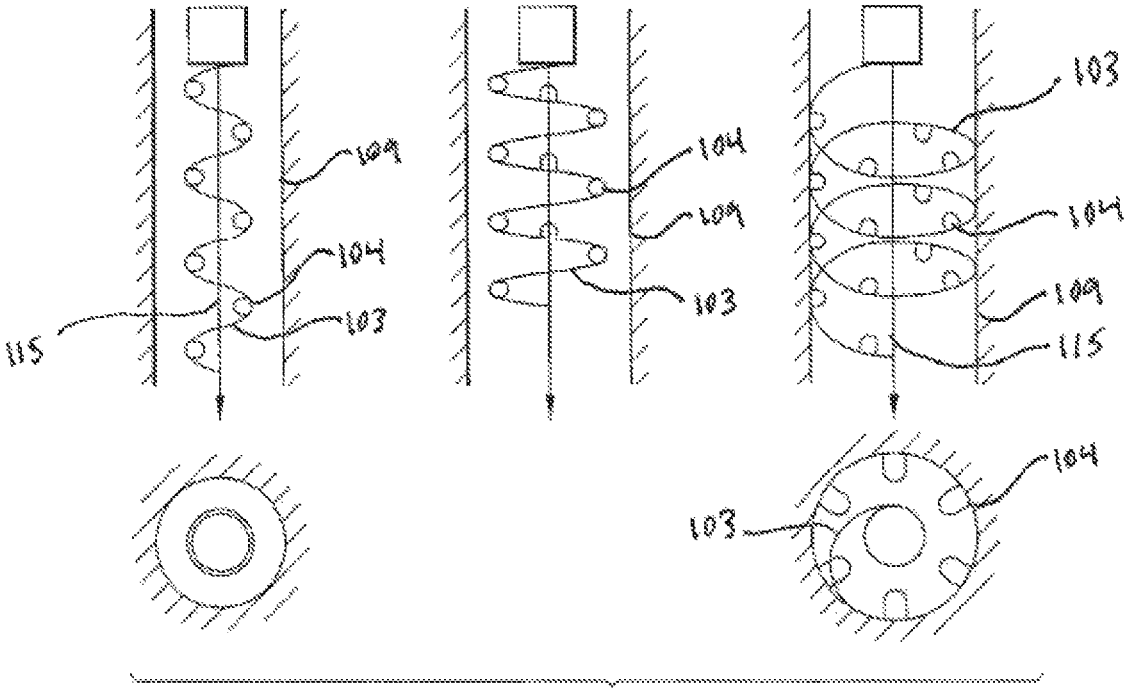

A further example embodiment of the present disclosure is depicted in FIG. 8, wherein shaped charges are placed in a spring coil type of flange that is extended by tensioning it. The controlled release of this tension will allow the perforating gun to increase its external diameter.

Figure 9:
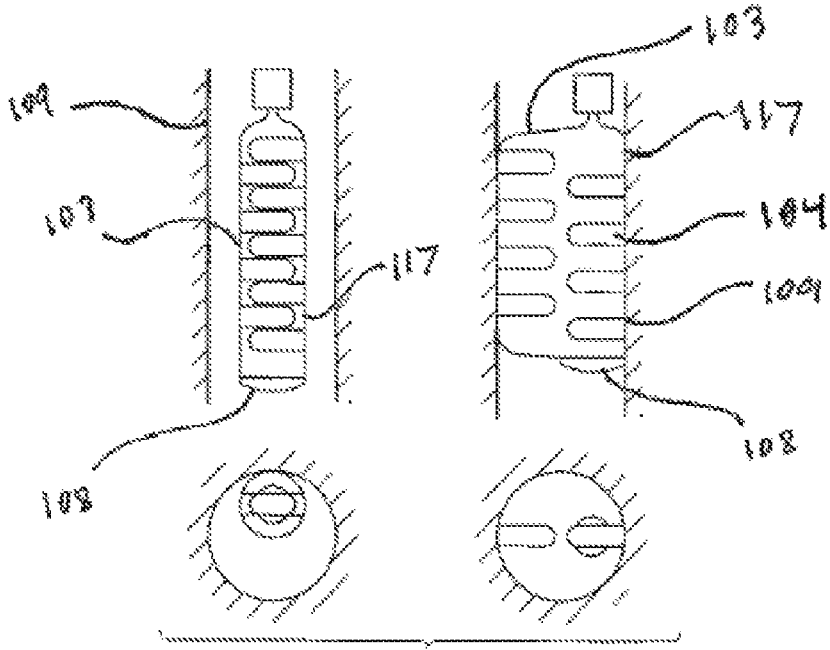

An additional example embodiment of the present disclosure is depicted in FIG. 9, wherein two flanges are used to transport the shaped charges downhole, these two flanges are compressed in order to increase the external diameter of the perforating gun.

Figure 10:
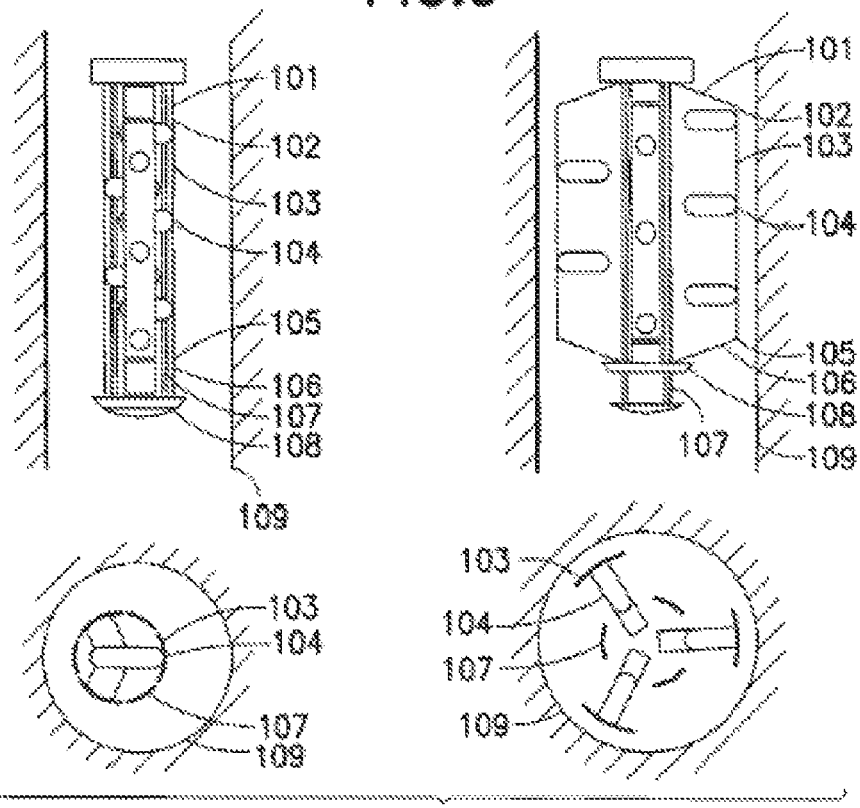

FIG. 10 shows a three flange example embodiment of the present disclosure with alternating shaped charges and using a three part structural support.

DETAIL DESCRIPTION OF THE PREFERRED EMBODIMENTS

In the following detailed description of the preferred embodiments, reference is made to accompanying drawings, which form a part hereof, and within which are shown by way of illustration specific embodiments by which the invention may be practiced. It is to be understood that other embodiments may be utilized and structural changes may be made without departing from the scope of the invention.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice. Further, like reference numbers and designations in the various drawings indicated like elements.

Figure 1:
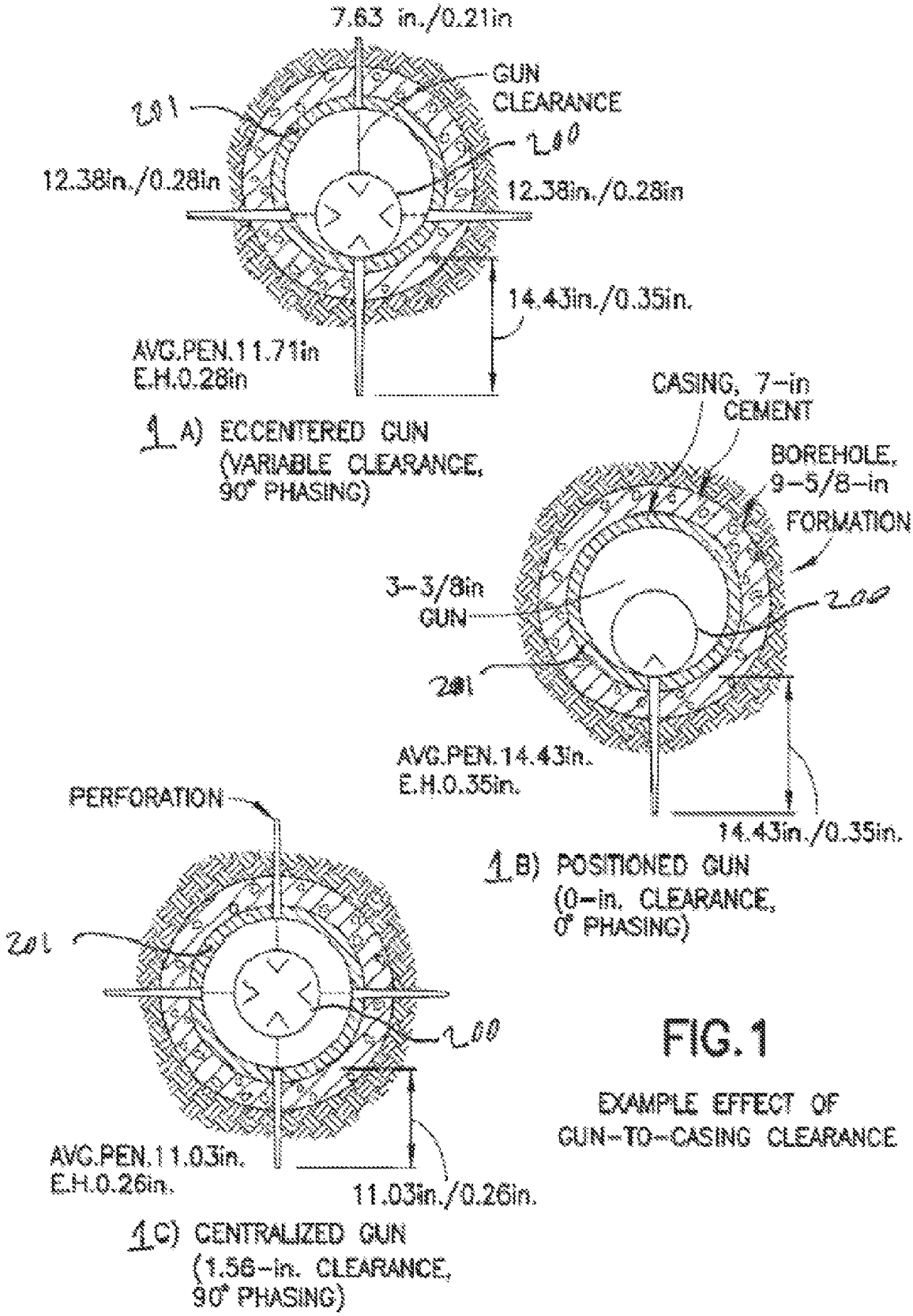

FIG. 1 shows the effect on the depth of penetration of a shaped charge in different water clearance or gun clearance. In FIG. 1A, an eccentered gun is shown where the shaped charge 200 facing the casing 201, and with the minimum water clearance, registered a depth of penetration of 14.43 inches while the shaped charge 201 facing the opposite way shows a depth of penetration of only 7.63 inches for this particular example. FIGS. 1B and 1C show the impact in depth penetration of a shaped charge 201 for a zero phased gun and a centralized gun.

Each of the following embodiments (other than the embodiment shown in FIG. 9) may be characterized as an apparatus for perforating wells having: 1) a plurality of perforating charges 104; 2) means for retaining the perforating charges in a first array, the first array having a first maximum cross sectional area; and 3) means for expanding the perforating charges into a second three dimensional array, the second array having a second maximum cross sectional area larger than the first maximum cross sectional area.

All of the following embodiments may alternatively be characterized as an apparatus for perforating wells having: 1) a plurality of perforating charges 104; 2) means for retaining the perforating charges in a first array, the first array having a primary axis and a first maximum cross sectional area and the perforating charges having firing directions oriented approximately perpendicular to the primary axis; and 3) means for expanding the perforating charges 104 into a second array, the second array having a second maximum cross sectional area larger than the first maximum cross sectional area.

Figure 2:
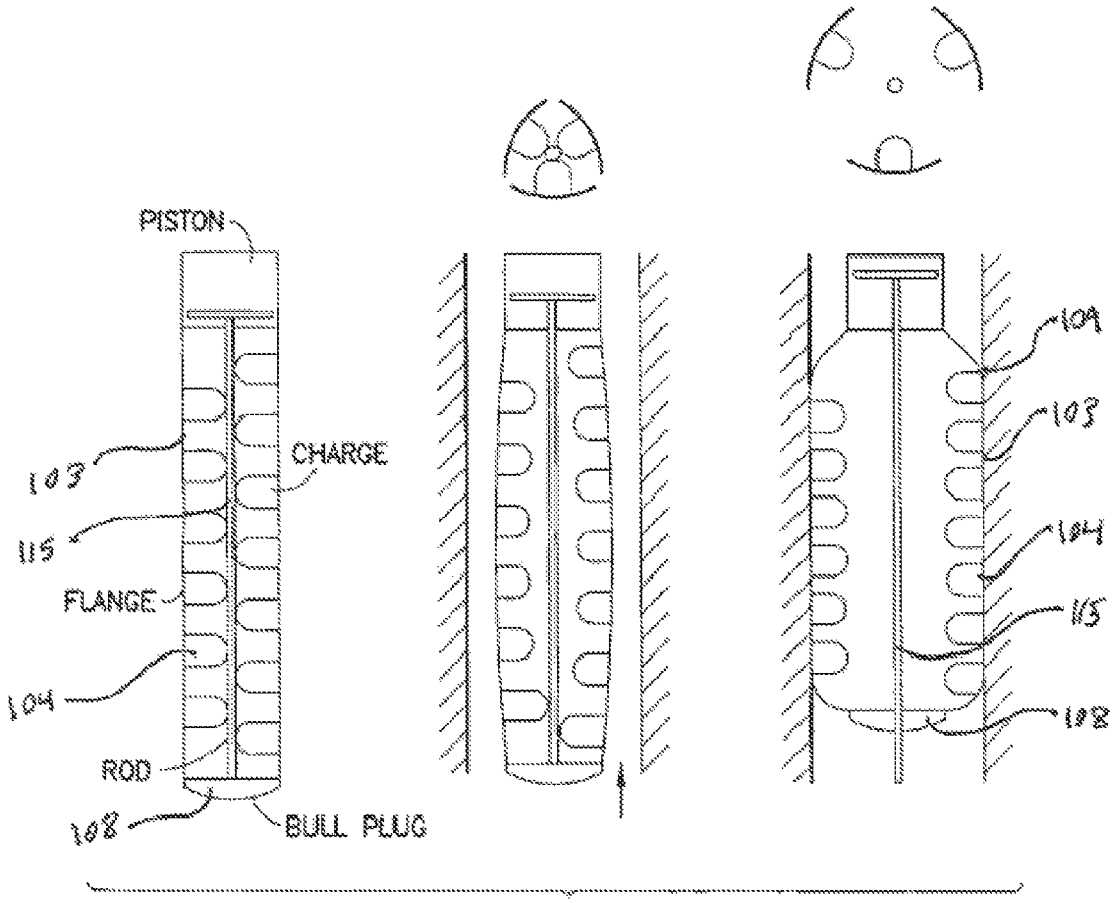

FIG. 2 shows an embodiment wherein three flanges 103 around a center rod 115 are used and the flanges 103 are loaded with shaped charges 104. A bull plug (moving mechanism) 108 at the bottom of the gun is driven up by a moving mechanism 108, this moving mechanism 108 could be a spring loaded mechanism, a piston driven mechanism or a like means to make the bull plug 108 move in the upwards direction. As the bull plug 108 moves up, it compresses the flanges that bow until they contact the casing wall 109, once all the flanges 103 are in contact with the casing 109 and the shaped charges 104 loaded in the flanges 103 are positioned in front of the casing wall 109 the bull plug 108 stops moving upwards. The upward movement of the bull plug 108 can be controlled by one or more of several means commonly used in the industry, as way of example and not to limit this disclosure it can be controlled by measuring the length the bull plug 108 travels or by the resistance the plug needs to overcome to keep its upward movement. Once the perforating gun is fully extended, the firing sequence can be started.

FIG. 3 shows a flanged 103 embodiment with a spiral design around a center rod 115, attached to a fixed adapter at the top and to a moving piece at the bottom. The spiral flange 103 is loaded with shaped charges 104. The moving piece 108 at the bottom of the perforating gun is rotated and the spiral flange 103 is "unwound" until the loaded portion of said spiral flange is in contact with the casing wall u109. The rotating movement of the moving piece 108 can be controlled by one or more of several means commonly used in the industry, as way of example and not to limit this disclosure it can be controlled by measuring the length the moving piece 108 travels, the number of turns, or by the resistance the moving piece 108 needs to overcome to keep its rotating movement. Once the perforating gun is fully extended the firing sequence can be started.

FIG. 4 shows an expandable tube loaded with shaped charges 104. While only a two dimensional cross section of the device is shown in FIG. 4, the device may also have other shaped charges 104 that are not shown in this view, such as shaped charges 104 centered about a plane perpendicular to the cross section shown (and normally vertically offset from the positions of the depicted shaped charges). The expandable tube has concentric inner and outer tubes, a center rod 115 inside the inner tube and a wedge 114 of a predetermined diameter at the bottom of the gun. As the wedge 114 moves upwards through the inner tube it expands both the inner and the outer tube increasing the outer diameter of the perforating gun and thereby reducing the water clearance. The wedge 114 is preferably of a shape designed to reduce the force needed to expand both expandable tubes. The upward movement of the wedge 114 can be controlled by one or more of several means commonly used in the industry, as way of example and not to limit this disclosure it can be controlled by measuring the length the wedge 114 travels or by the resistance the wedge 114 needs to overcome to keep its upward movement. Once the perforating gun is fully extended, the firing sequence can be started.

FIGS. 5 and 6 show concepts of inflatable perforating guns. FIG. 5 shows an inflatable perforating gun wherein the shaped charges 104 are attached to the inside of an inflatable bladder 116. The inflatable bladder 116 can be extended by pumping fluid into the bladder 116. Means to inflate the bladder 116 are well known throughout the industry and a person of ordinary skill in the art will realize there are several ways to inflate this apparatus, as way of example the pumping mechanism used to inflate retrievable packers or straddle packers can be used. Once the perforating gun is fully inflated, the firing sequence can be started. FIG. 6 is a variation of the previous embodiment wherein the shaped charges 104 are positioned inside an expandable tube with an inner inflatable bladder 116. The bladder 116 when inflated will increase the diameter of the expandable tube and therefore positioning the shaped charges 104 closer to the casing wall 109. While only two dimensional cross sections of the devices are shown in FIGS. 5 and 6, these devices may also have other shaped charges 104 that are not shown in these views, such as shaped charges 104 centered about planes perpendicular to the cross sections shown (and normally vertically offset from the positions of the depicted shaped charges).

FIG. 7 shows another embodiment of the present disclosure wherein the shaped charges 104 are housed inside capsules that extend outside of the perforating gun 110 by applying internal pressure. As pressure is applied inside the perforating gun 110 the capsules will protrude from the perforating gun reducing the water clearance. The embodiment shown in FIG. 7 is different from the earlier described embodiments in that the distance between the first perforating charge 104 and the last perforating charge 104 increases as the shaped charges are extended outside the perforating gun 110. In the earlier described embodiments, this distance is decreased because the perforating gun 110 is substantially "shortened" as the shaped charges 104 are brought into contact with the casing 109. While only a two dimensional cross section of the device is shown in FIG. 7, the device may also have other shaped charges 104 that are not shown in this view, such as shaped charges 104 centered about a plane perpendicular to the cross section shown (and normally vertically offset from the positions of the depicted shaped charges).

FIG. 8 shows a flange 103 with a spiral design, a center rod 115 and a moving piece 108. The flange 103 is attached at the top to a fixed adapter and at the bottom to a moving piece 108. Shaped charges 104 are loaded in a spring coil type of flange 103 that is distended by applying tension to it at surface before running the perforating gun into the well; the controlled release of this tension will allow the perforating gun to increase its external diameter up to the internal diameter of the casing 109. The release of the tension on the spring coil flange 103 can be controlled by one or more of several means known and commonly used in the industry for such applications, by way of example and not to restrict the breath of the disclosure, an electrical signal sent from a surface computer can activate a diode that in turns releases the moving piece 108 and therefore allowing the spring coil flange 103 to coil up and increase its diameter. Once the perforating gun is fully extended, the firing sequence can be started.

FIG. 9 shows a hinged moving flange 103, a fixed flange 117 and a moving piece 108. Both of the flanges are loaded with shaped charges 104. The flanges 103 are positioned facing each other and with alternating shaped charges 104 as to minimize the outer diameter of the gun before being expanded. As the moving piece travels upwards, it will push the hinged moving flange 103 radially outwards until the hinged moving flange 103 and the fixed flange 117 are in contact with the casing wall 109. Once the perforating gun is fully extended the firing sequence can be started. The embodiment shown in FIG. 9 is different from the earlier described embodiments in that the expansion of the perforating charges from the first array to the second array is intentionally asymmetric.

FIG. 10 shows a set of three hinged flanges, a rigid structure 107 and a moving piece 108. The hinged flanges comprise a top extending flange piece 101, a top hinge 102, a loading flange 103, a bottom hinge 105 and a bottom extending flange piece 106 and a multitude of perforating shaped charges 104 securely attached to the loading flanges 103. The perforating shaped charges 104 are loaded in an alternated way on the three loading flanges 103 as to minimize the outer diameter of the perforating gun before it is run into the well. The rigid structure 107 comprises of three structural flanges. As the movable piece 108 moves upwards along the rigid structure 107 it compresses the hinged flanges and extend the loading flanges 103 until all of the loading flanges are in contact with the casing 109 wall. Once the perforating gun is fully extended the firing sequence can be started.

While each of these embodiments could incorporate a shaped charge rotating mechanism as described in U.S. Pat. No. 5,095,801, for the sake of simplicity, robustness, and reduction of cost, the perforating charges will preferably have firing directions oriented approximately perpendicular to the primary axis as the gun is run into the wellbore. Another advantage of this type of orientation is that the guns may still be fired even if there are problems fully expanding the shaped charges from the first array to the second array within the wellbore.

While the invention is described through the above exemplary embodiments, it will be understood by those of ordinary skill in the art that modification to and variation of the illustrated embodiments may be made without departing from the inventive concepts herein disclosed. Accordingly, the invention should not be viewed as limited except by the scope of the appended claims.

The invention claimed is:

1. An apparatus for perforating wells comprising a plurality of perforating charges;

means for retaining said perforating charges in a first array, said first array having a first maximum cross sectional area and a primary axis, the perforating charges in the first array having firing directions oriented approximately perpendicular to the primary axis; and means for expanding the cross sectional area of said first array into a second three dimensional array, said second array having a second maximum cross sectional area larger than said first maximum cross sectional area;

wherein said means for expanding comprises a movable piece and a mechanism to move said moveable piece; and said means to retain said perforating charges comprises:

i. at least one flange securely attached in one end to a fixed adapter and in the other to said movable piece, and;

ii. said plurality of perforating charges securely attached to said at least one flange, wherein said mechanism moves said movable piece in a direction to compress said at least one flange thereby expanding said first array into said second array.

2. An apparatus in accordance with claim 1, wherein said first array has an associated first distance between a first perforating charge in said array and a last perforating charge in said array and wherein said means for expanding said first array reduces the distance between said first perforating charge and said last perforating charge.

3. An apparatus for perforating wells comprising a plurality of perforating charges;

means for retaining said perforating charges in a first array, said first array having a first maximum cross sectional area and a primary axis, the perforating charges in the first array having firing directions oriented approximately perpendicular to the primary axis; and means for expanding the cross sectional area of said first array into a second three dimensional array, said second array having a second maximum cross sectional area larger than said first maximum cross sectional area, wherein said means for expanding comprises a movable piece and a mechanism to move said moveable piece; and said means for retaining said perforating charges comprises:

i. a fixed flange and a movable flange parallel to each other securely attached at one end to a fixed adapter and at the other end to said movable piece, and;

ii. said plurality of perforating charges are securely attached to said flanges, wherein said movable piece is able to move along said fixed flange while compressing said movable flange; as said movable flange is compressed by said movable piece said first array is expanded into said second array.

4. An apparatus for perforating wells comprising a plurality of perforating charges;

means for retaining said perforating charges in a first array, said first array having a first maximum cross sectional area and a primary axis, the perforating charges in the first array having firing directions oriented approximately perpendicular to the primary axis; and means for expanding the cross sectional area of said first array into a second three dimensional array, said second array having a second maximum cross sectional area larger than said first maximum cross sectional area, wherein said means for expanding comprises a movable piece and a mechanism to move said moveable piece; and said means for retaining said perforating charges comprises:

i. one or more movable flanges securely attached at one end to a fixed adapter and at the other end to said movable piece, ii. a rigid structure comprising at least two structural flanges, and;

iii. said plurality of perforating charges are securely attached to said one or more movable flanges, wherein said movable piece is able to move along said structural flanges while compressing said one or more movable flanges; as said one or more movable flanges are compressed by the movable piece said first array is expanded into said second array.

5. An apparatus for perforating wells comprising a plurality of perforating charges;

means for retaining said perforating charges in a first array, said first array having a first maximum cross sectional area and a primary axis, the perforating charges in the first array having firing directions oriented approximately perpendicular to the primary axis; and means for expanding the cross sectional area of said first array into a second three dimensional array, said second array having a second maximum cross sectional area larger than said first maximum cross sectional area, wherein said means for expanding comprises a movable piece and a mechanism to move said moveable piece; and said means for retaining said perforating charges comprises:

i. three hinged flanges securely attached at one end to a fixed adapter and at the other end to said movable piece, ii. said hinged flanges comprising a top extending flange piece, a top hinge, a loading flange, a bottom hinge and a bottom extending flange piece, iii. said plurality of perforating charges are securely attached to said loading flanges, iv. a rigid structure comprising of three structural flanges, wherein said movable piece is able to move along the rigid structure while compressing said hinged flanges as said first array is expanded into said second array.

6. An apparatus in accordance with claim 5, wherein said plurality of perforating charges are alternated and securely attached to each of said three loading flanges.

7. An apparatus in accordance with claim 5, wherein, if viewed in cross section, each hinged and structural flange alternate.

8. An apparatus for perforating wells comprising:

i. one or more flanges securely attached at one end to a fixed adapter and at the other to a movable piece, ii. a multitude of shaped charges securely attached to said one or more flanges, iii. a rod, said movable piece able to move along said rod, iv. a mechanism to move said movable piece, and v. initiating means to detonate said shaped charges.

9. An apparatus as in claim 8, wherein:

i. said movable piece is initially located near a bottom of said rod, ii. said fixed adapter is located near a top of said rod, and iii. said mechanism to move said movable piece moves said movable piece up or down said rod.

10. An apparatus for perforating wells comprising:

i. three hinged flanges securely attached at one end to a fixed adapter and in the other to a movable piece, ii. said hinged flanges comprising a top extending flange piece, a top hinge, a loading flange, a bottom hinge and a bottom extending flange piece, iii. a multitude of shaped charges securely attached to said loading flanges, iv. a rigid structure comprising three structural flanges, v. said movable piece being able to move along said rigid structure while compressing said hinged flanges, vi. a mechanism to move said movable piece, and vii. initiating means to detonate said shaped charges.

* * * * *